United States Patent [19]

Stoecker

[11] 4,171,802

[45] Oct. 23, 1979

[54] HYDRAULIC TORQUE REACTION WRIST AND ARM EXERCISER

[76] Inventor: Carl H. Stoecker, 3718 NE. 192nd, Seattle, Wash. 98155

[21] Appl. No.: 859,320

[22] Filed: Dec. 12, 1977

[51] Int. Cl.[2] ..... A63B 21/00

[52] U.S. Cl. ..... 272/67; 272/130; 272/143; 272/DIG. 1; 272/DIG. 4

[58] Field of Search ..... 272/140, 130, 132, DIG. 3, 272/143, 116, DIG. 1, 137, 73, 67, 68

[56] References Cited

U.S. PATENT DOCUMENTS

| | | | |
|---|---|---|---|
| 2,042,764 | 6/1936 | Birch | 272/130 X |
| 3,494,616 | 2/1970 | Parsons | 272/130 X |
| 3,495,824 | 2/1970 | Cuinier | 272/130 |
| 3,784,194 | 1/1974 | Perrine | 272/130 |
| 3,926,430 | 12/1975 | Good | 272/130 |

*Primary Examiner*—Richard C. Pinkham

*Assistant Examiner*—William R. Browne

*Attorney, Agent, or Firm*—Christensen, O'Connor, Johnson & Kindness

[57] ABSTRACT

A hand-held wrist and arm exerciser employing rotary motion and including a resistance torque device with first and second relatively rotatable units mounting hand grips. The units are spaced substantially equidistant between the hand grips. Resistance torque is developed within the device accompanying rotational effort applied through the hand grips, such torque being determined by the restriction of flow of hydraulic fluid between compartments of an annular chamber, increasing in proportion to turning effort applied to the device and being adjustable by externally operable valve mechanism for changing the size of the flow restriction. One of the units has a mechanism for restricting fluid movement therefrom.

10 Claims, 6 Drawing Figures

10
12
14
16
18
20
22
24
26
A

Fig. 4.
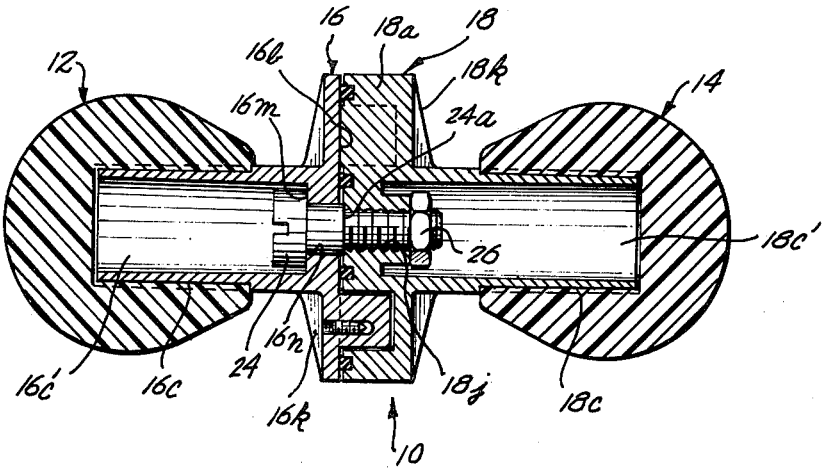
Fig. 5.
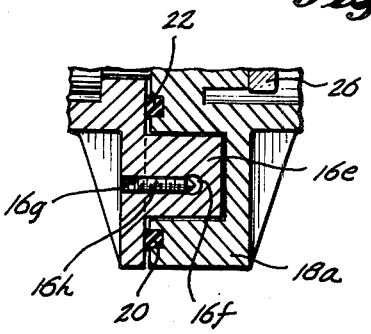
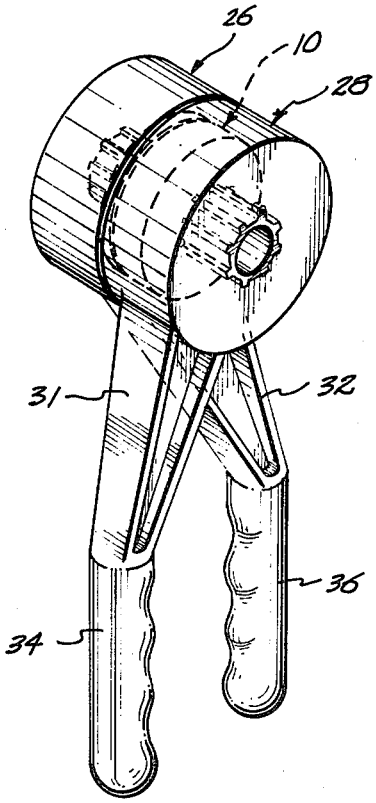
Fig. 6.

HYDRAULIC TORQUE REACTION WRIST AND ARM EXERCISER

BACKGROUND OF INVENTION

This invention relates to an improved wrist and arm exerciser generally of the type employing hand grips and a resistance torque device therebetween that reacts to and resists relative turning motion applied through the hand grips. The invention is herein illustratively described by reference to the presently preferred embodiments thereof; however, it will be recognized that certain modifications and changes therein with respect to details may be made without departing from the essential features involved.

It has long been known, of course, that the development and strengthening of wrist and arm muscles can be accomplished through daily exercises that repeatedly stress the muscles and that uniformity of development requires working all the muscles. Among the better exercises of this nature are those which require the participant to pit the strength of one arm against the other. While "isometrics" excercises can be performed in variety sufficient to work most of the muscles, it is found that muscle strains that change due to motion or changes of position are very helpful. For example, wrist and arm exercises involving forceful turning of a rotary resistance torque device held between the hands about an axis parallel to the line of the shoulders and that may, if desired, be canted into different orientations relative to that line in order to vary the exercise are highly effective. Exerting turning force first in one direction and then oppositely in alternate sequence over a period of time, with the exercises graduated from easy beginnings to more strenuous effort as the strength and stamina of the participant develop are highly effective.

In the course of investigating prior art exercising devices, a number of United States patents were located of varying degrees of interest and pertinence as background to the present improvements. These are as follows: U.S. Pat. Nos. 3,955,655; 3,944,221; 3,807,729; 3,764,131; 3,717,338; 3,495,824; 3,396,967.

An important purpose of the present invention is to provide a rotary resistance torque type wrist and arm exerciser that, unlike those employing relatively rotatably elements worked against the increasing stress of a return spring, permits the user to incur or experience immediate selected resistance torque in response to and measured by turning effort applied in either direction through the hand grips. Another and related object is to provide such an exerciser that eliminates the disadvantages of working against friction discs or bands rubbing together. Wear, static friction to be overcome and a tendancy for resistance torque to decrease as relative rotation speed between the discs or bands is increased tend to impose certain torque charateristics on devices of this nature that are considered to be less than satisfactory.

An important object is to overcome such difficulties and limitations in a device of small bulk and weight requirements and economical to manufacture. More specifically, it is an object hereof to provide a device the units of which can be started into relative rotation smoothly without encountering a large starting resistance in either direction of rotation. A further object hereof is to devise a wrist and arm exerciser in which the resistance torque developed within it increases with attempts to increase the relative rotational speed of the units and which thereby inherently affords to the user a wide range of exercise forces available to the user without the necessity of making any mechanical adjustments. However, it is also an object hereof to devise such a mechanism or exerciser with provision for convenient adjustability of the relative rotation resistance torque characteritic thereof.

Still another object hereof is to provide a versatile exerciser in which the resistance torque device therein is readily adapted for interchangeability of hand grips of different types, including rounded knobs that enable the user to grip and hold the unit in different hand positions, thus to vary the exercises of the muscles in the wrist and forearms, and also a scissor-type hand grip arrangement in which the forces are borne in a different manner by the wrists and forearms without less taxing of the hand muscles.

BRIEF DESCRIPTION OF THE INVENTION

As herein disclosed, the invention resides in an exerciser comprising a pair of hand grips and a resistance torque device including first and second units respectively mounting the hand grips and interconnected to permit relative rotation therebetween about a common axis. Formed cooperatively by or within the first and second units of the torque device, is an annularly extending chamber sealed to hold hydraulic fluid such as grease. One of the units incorporates partition means forming opposite end walls for the chamber and the other unit incorporates a vane projecting therefrom into the chamber in a sliding fit and serving as a two-way plunger dividing the chamber into compartments that are varied oppositely in volume by the vane accompanying relative rotary motion of the units one way or the other. The force required through the hand grips to rotate the units relatively is determined by the viscosity of the fluid chosen and by the size or calibration of a flow restriction permitting the fluid to pass from one compartment to the other accompanying relative rotation between the units. While the flow restriction may, for example, comprise an aperture through the partition means in the first unit, it is perferably an aperture through the vane on the second unit.

As a further feature a screw threaded through the second unit into the aperture through the vane permits controlling the size of the aperture from the exterior of the device in a convenient manner.

Still other features reside in providing such an exerciser having hand grips that are symmetrically rounded in the form of knobs permitting the user to grip the same with the hands in varying positions and thus thereby to exercise the wrists and arm muscles in different ways. For example, the hands may be applied to such grips with the palms facing each other, or with both palms facing upward, with both facing downward, or with one palm facing upward and the other facing downward, or at various intermediate angular orientations relatively. In this way the muscles around the entire perimeter of the wrists and forearms can be exercised selectively and in repeating cycles by alternately reversing the direction of relative rotation.

With the hand grips removably mounted on the exerciser resistance torque units, another form of hand grip may be substituted, comprising elongated handles mounted at right angles to the rotation axis of the exerciser may be employed and in this way the user may work the exerciser back and forth in the manner of working the handles of pruning shears or the like.

These and other features, objects and advantages thereof will become more fully evident from the following description by reference to the accompanying drawings.

BRIEF DESCRIPTION OF DRAWINGS

FIG. 4 is a longitudinal sectional view of the exerciser shown in FIG. 1 taken on an axial plane to reveal interior details with the parts assembled.

FIG. 5 is an enlarged fragmentary sectional view illustrating the formation of the fluid impeller or vane on one unit cooperating with the chamber in the other unit and also illustrating the fluid seals and adjustment screw for varying the flow restriction through the vane aperture.

FIG. 6 is an isometric view illustrating an alternate handle arrangement for the improved exerciser.

DESCRIPTION OF ILLUSTRATED EMBODIMENTS

Figures 1, 2, 3:
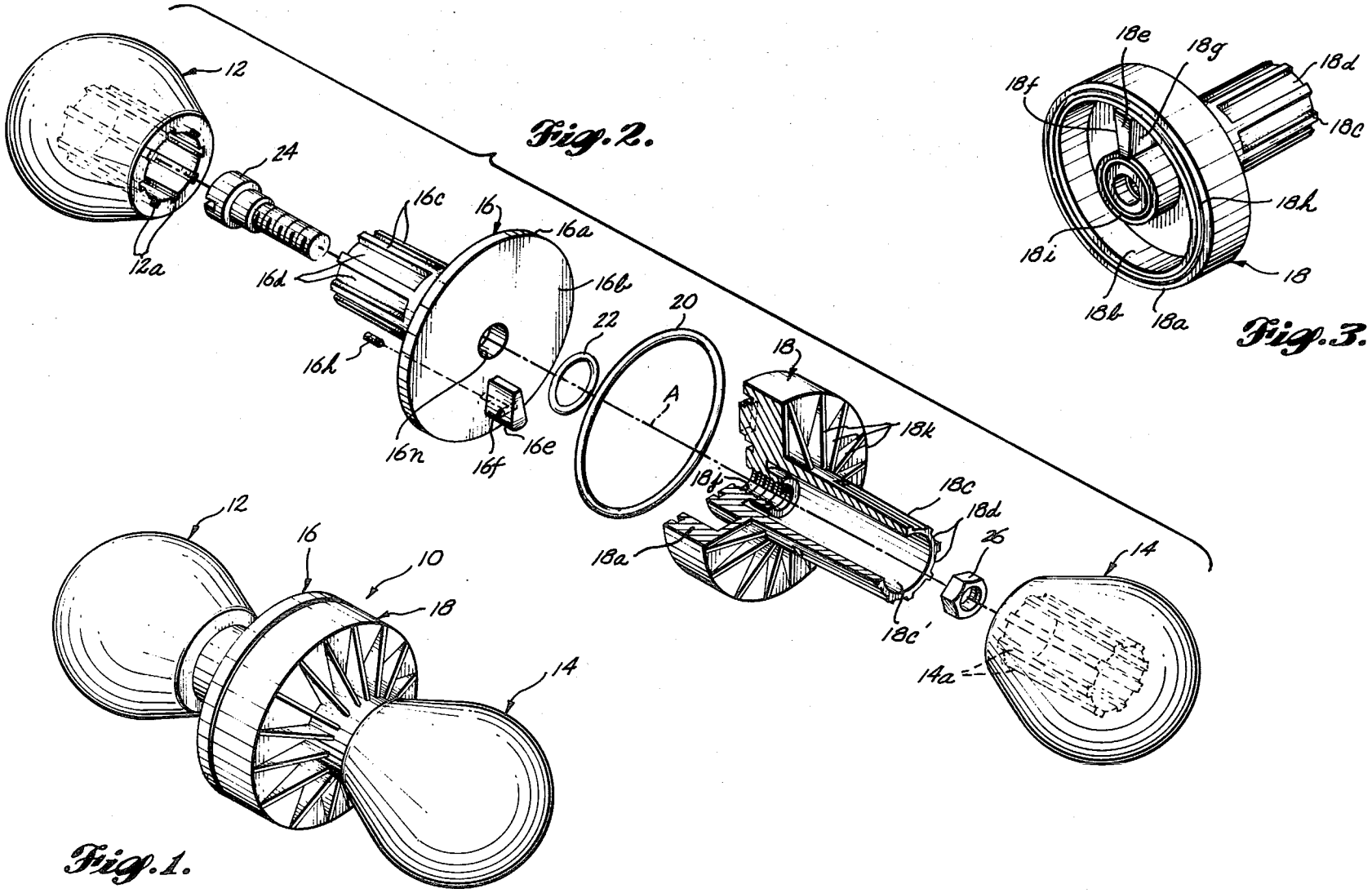
FIG. 1 is an isometric view of the improved exerciser having hand grips of the rounded knob type.
FIG. 2 is an exploded isometric view of the same exerciser shown in FIG. 1 with the parts separated axially.
FIG. 3 is an isometric view of one of the resistance torque device units showing the annularly extending hydraulic fluid chamber therein and other details.

Referring to FIGS. 1 to 5, the improved exerciser comprises a pair of hand grips 12 and 14 mounted upon and interconnected by a resistance torque device 10. The resistance torque device 10 includes first and second relatively rotatable units 16 and 18 which have parts that are formed and arranged to cooperate in such a manner as to develop the desired resistance torque characteristics set forth within the above statement of objectives.

Unit 16 preferably comprises a disc-like body **16*a* with an inner flat or planar face 16*b* perpendicular to the relative rotational axis A of the device. Opposite the face 16*b* the unit has an axially projecting tubular shaft 16*c* preferably provided with a circumferential series of longitudinally extending grooves that form ribs or keys between them designed to fit removably into similar grooves 12*a* in the wall of a longitudinal bore formed in the adjacent end of the hand grip knob 12. The body 18*a* of unit 18 is also of generally annular or disc-like form, but preferably somewhat thicker axially and is likewise provided with an axially projecting tubular shaft 18*c*. The exterior of shaft 18*c* is grooved longitudinally at intervals around its periphery so as to engage complemental ribs and grooves formed in the wall of a central bore in hand grip 14. Thus, the hand grips may be slipped longitudinally on and removed from the hollow shafts 16*c* and 18*c*** and in the installed position will securely engage the respective shafts for application of rotational torque thereto.

The inner face of the annular body **18*a* is formed with an annularly extending groove or chamber 18*b* therein facing and in confrontal proximity to the opposing face 16*b*. A radial partition 18*e* is incorporated in the unit body 18*a* to form opposite end walls 18*f* and 18*g* for groove 18*b***.

The opposing unit body **16*a* has a radially extending vane 16*e* projecting from the end face 16*b* thereof and adapted to enter into the groove or chamber 18*b* with a sliding fit therein enabling it to function as a form of piston or paddle adapted to compress hydraulic fluid incorporated in the groove 18*b* against one end wall 18*f* or the other 18*g*, depending upon the direction of relative rotation between the units. A bore or aperture 16*f* extending laterally through the vane 16*e* permits hydraulic fluid to flow from one side of the vane to the opposite side accompanying relative rotation between the units. A threaded bore 16*g* in the body of the unit 16 receives an adjustment screw 16*h*, the tip of which can be caused to enter the aperture 16*f*** by varying amounts in order to vary the size of the flow restriction afforded by the aperture.

Surrounding the annularly extending chamber **18*b* in the unit body 18*a* is a shallow aperture 18*h* adapted to receive an elastic "O" ring 20. A similar shallow aperture 18*i* in the unit body 18*a* surrounded by the groove 18*b* also accommodates an elastic "O" ring 22. These "O" rings project slightly from their respective grooves when nested therein so as to be compressed against the face 16*b* of unit body 16*a* when the units are secured together in relative operating positions as depicted in FIG. 4. Thus, the compressed "O" rings serve as inner and outer seals preventing escapement of hydraulic fluid trapped within the annularly extending chamber 18*b* and placed under compression in either of the two compartments thereof formed by the presence of the rotatively reciprocative vane 16*e***.

In order to interconnect the cooperating units in coaxial alignment so as to permit their relative rotation while preventing relative axial separation thereof, the hub or inner portion of the unit body **18*a* has a threaded axial bore 18*j* accessible through the hollow interior 18*c*' of the open end tubular shaft 18*c*. A somewhat larger bore 16*n*, unthreaded, formed axially in the unit body 16*b* is also accessible through the hollow interior 16*c*' of hollow tubular shaft 16*c*. With the hand grips 12 and 14 removed and the units 16 and 18 pressed together, with the chamber 18*b* filled with grease or other hydraulic fluid, the bolt 24 may be inserted through the hollow of shaft 16*c* until its shoulder 24*a* abuts the end face of unit body 18*a* and its threaded end portion projects beyond the bore 18*j* to receive the nut 26 installed through the opposite shaft bore 18*c*'. The underside of the head of bolt 24 presses against the step 16*m* as the shoulder 24*a* abuts the end face of unit body 18*a*. The distance between these elements (i.e., the under side of the bolt head and the bolt shoulder 24*a*) is such that tightening of the knob 26 on the bolt places the rubber "O" rings 20 and 22 under the desired degree of compression to effect a seal without unduly increasing the mechanical rubbing friction between the solid parts of the interconnected units 16 and 18**.

Gussets or ribs **18*k* reinforce the junction between the tubular shaft 18*c* and the unit body 18*a*. Similar ribs 16*k* strengthen the junction between the unit body 16*a* and the tubular shaft 16*c*** joined thereto.

As depicted, removable knob-like hand grips 12 and 14 are preferably spherically rounded, rather than being simply cylindrical, for example. As a consequence the device affords a greater variety of specific muscle exercises due to the greater variety of ways in which these grips may be held comfortably in the user's hands.

In operation, hydraulic viscosity of the fluid selected for incorporation in the chamber **18*b* directly affects the resistance to relative rotation and hence the amount of torque or force that must be applied by the user. The faster the user attempts to rotate the parts relatively, the greater the resistance or torque reaction encountered. This also applies to the starting force necessary to rotate the units in either direction from any starting position. It can be made either large or small depending upon whether the user attempts to rotate the units rapidly initially. For example, by the user exerting maximum effort from the start, full muscular stress can be developed throughout the entire relative rotational stroke in either direction. Alternatively, or slow and easy start can be succeeded by a progressive increase of effort as the stroke continues. In all cases the force required at all points throughout the stroke is wholly within the user's control and can be varied at will. There is no substantial starting friction to overcome such as in certain prior art devices. The head of calibration screw 16*h* is accessible from the exterior of the device permitting the tip of the screw to be advanced or retracted in the flow aperture 16*f* in the vane 16*e*** so as to increase or decrease the resistance torque factor as desired.

In the embodiment shown in FIG. 6, the relatively rotatable units 26 and 28 mount radially extending arms 30 and 32, respectively, that are angled slightly toward each other in relation to a mid-plane perpendicular to the relative rotational axis between the units 26 and 28. These arms 30 and 32, respectively, carry hand grips 34 and 36 that, because of the aforementioned offset, are positioned substantially in the same plane perpendicular to the rotational axis of the units. Preferably the interior details of construction and the mode and manner of operation of the resistance torque device comprised in the units 26 and 28 is the same as or similar to the corresponding units in the first described embodiment.

The invention has thus been described in its presently preferred embodiments illustrative and not delimiting with respect to the intended scope of interpretation of the claims hereafter defining the novel combinations comprising the invention.

The invention in which an exclusive property or privilege is claimed is defined as follows:

1. A hand held relatively rotary motion wrist and arm exerciser comprising a pair of hand grips and a fluid resistance type torque device, said torque device comprising first and second units each mounting a hand grip, said units being interconnected to permit relative rotation therebetween about a common axis while preventing relative axial separation thereof, said units being spaced substantially equidistant between and in alignment with the hand grips, and said units having mutually opposing surfaces, said units having mutually opposing surfaces transverse to said common axis cooperatively forming an annularly extending chamber sealed to hold hydraulic fluid therein, said first unit incorporating partition means forming opposite end walls for the chamber, said second unit incorporating vane means projecting therefrom into said chamber in a sliding fit therein dividing the chamber into compartments that vary oppositely in volume accompanying relative rotary motion of the units, at least one of said units being formed with means permitting restricted flow of hydraulic fluid between said compartments accompanying such relative rotary motion, thereby to create a relative torque between said hand grips during an exercise for the arms and wrists of a user when the hands of a user are in gripping contact with the hand grips.

2. The exerciser defined in claim 1 wherein the last-mentioned means comprises an aperture through said vane means.

3. The exerciser defined in claim 2 including adjustable flow restricter means adjustable from the exterior of the exerciser to vary the effective size of the aperture.

4. The exerciser defined in claim 3 wherein the adjustable flow restricter means comprises a screw threaded through the second unit to protrude varially into said aperture.

5. The exerciser defined in claim 4 wherein the hand grips comprise axially projecting symmetrically rounded knobs.

6. The exerciser defined in claim 4 wherein the hand grips comprise radially projecting elongated handles.

7. The exerciser defined in claim 6 wherein the handles are rotatable about a common axis in spaced-apart planes that are perpendicular to the rotation axis.

8. The exerciser defined in claim 1 wherein the first unit comprises a generally annular member having a substantially planar face perpendicular to the axis, the vane means projecting from said face generally parallel to the axis, and wherein the second unit comprises a second generally annular member having a face in confrontal proximity to said planar face and having an annularly extending groove forming said chamber into which said vane means projects, and a first elastic "O" ring seal concentrically surrounding said groove and compressed between the faces with the units interconnected so as to effect a seal against discharge of hydraulic fluid outwardly from between said faces.

9. The exerciser defined in claim 8 wherein a second elastic "O" ring seal concentrically surrounded by said groove and compressed between said faces with the unit interconnected so as to effect a seal against discharge of hydraulic fluid inwardly from between said faces, said first and second generally annular members having axially aligned bores therein, and clamping means extending through said bores within said second "O" ring seal to clamp the members together while permitting relative rotation therebetween.

10. The exerciser defined in claim 9, wherein the first and second generally annular members have respective coaxially aligned shafts that project oppositely from the resistance torque device, said shafts being formed and arranged to permit mounting of differently shaped hand grips thereon.

* * * * *